US006371676B1

(12) United States Patent
Furukawa et al.

(10) Patent No.: US 6,371,676 B1
(45) Date of Patent: Apr. 16, 2002

(54) COLLECTOR FOR A WRITING IMPLEMENT

(75) Inventors: Kazuhiko Furukawa, Kanagawa; Yojiro Sano, Tokyo, both of (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/831,459

(22) PCT Filed: Nov. 19, 1999

(86) PCT No.: PCT/JP99/06470

§ 371 Date: May 8, 2001

§ 102(e) Date: May 8, 2001

(87) PCT Pub. No.: WO00/30866

PCT Pub. Date: Jun. 2, 2000

(30) Foreign Application Priority Data

Nov. 19, 1998 (JP) ..... 10-329643
Nov. 19, 1998 (JP) ..... 10-329644
Nov. 19, 1998 (JP) ..... 10-329645

(51) Int. Cl.[7] ..... B43K 5/02
(52) U.S. Cl. ..... 401/224; 401/227
(58) Field of Search ..... 401/224, 222, 401/223, 275, 227

(56) References Cited

U.S. PATENT DOCUMENTS 2,681,041 A * 6/1954 Zodtner et al. ..... 401/223
4,556,336 A * 12/1985 Sano et al. ..... 401/224

FOREIGN PATENT DOCUMENTS

| | | | |
|---|---|---|---|
| JP | 61-45191 | 3/1986 | ..... B43K/7/10 |
| JP | 3-31580 | 7/1991 | ..... B43K/5/18 |
| JP | 3-31581 | 7/1991 | ..... B43K/5/18 |
| JP | 2517432 | 11/1996 | ..... B43K/5/18 |
| JP | 9-104194 | 4/1997 | ..... B43K/5/18 |

* cited by examiner

*Primary Examiner*—David J. Walczak
(74) *Attorney, Agent, or Firm*—Darby & Darby

(57) ABSTRACT

A collector for adjusting internal pressure of a writing implement offers improvements in deficiency prevention performance such as the capability of preventing ink leakage from occurring due to influence of the ambient pressure being varied during usage or when its cap is put on and off, the capability of preventing ink from erupting or leaking forward when the implement has been stored at a shop for a long period, and which still provides smooth writing comfort during writing. A collector (106) introduces ink through an ink channel (114) by the function of capillary action and temporarily holds ink in ink retaining grooves (113) and establishes air passage in the axial direction and radial direction by the combination of the air channel (115) and retaining grooves (113). The air channel is continuously formed so as to zigzag with a multiple number of turns with respect to axial direction of collector (106) by way of air channel parts (115*a*, 115*b*, 115*c* and 115*d*) and connecting passages (122*a*, 122*b* and 122*c*). This zigzagging configuration makes it possible to reduce ink eruption due to inrush of ink from the ink tank to the retaining grooves of the collector when a sharp change in temperature or pressure occurs.

9 Claims, 18 Drawing Sheets

(PRIOR ART)

COLLECTOR FOR A WRITING IMPLEMENT

TECHNICAL FIELD

The present invention relates to improvement of a direct-feed type writing implement having a point assembly as a writing portion at the tip, such as a ball-point pen, felt pen, fountain pen, etc., comprised of an ink tank for direct ink storage, a collector as an adjusting element made up of multiple thin plates(vanes) for adjusting the internal pressure using capillary action, an ink feeder means for feeding ink from the ink tank to the point assembly. The present invention particularly relates to improvement of a collector so as to be adjustive to a sharp change in temperature and pressure.

BACKGROUND ART

In order to reduce the occurrence of forward leakage from the writing point and the occurrence of backward leakage smudging clothes and causing writing deficiency due to ink falling during writing with its pen point up, conventionally known oil-based ball-point pens use high viscosity ink, typically ranging from about 3,000 to 10,000 mPa·sec (milipascal·second) with a narrow ink tank to obtain enhanced capillarity. Therefore,the conventional oil-based ball-point pens suffers from the problems of heavy writing sensation, blotting, drawn line unevenness during writing and thin density because of their high ink viscosity and its narrow tank.

There have been known so-called sliver type pens which have a sliver of fabric bundles impregnated with a low viscosity ink of some mPa·sec and an ink feed for feeding ink to their pen point. This sliver type pen, however, has the problem of ink consumption being indiscernible and the problem of the drawn line being unstable such that an ample amount of ink flows out and hence thick drawn lines can be obtained in the starting stage and the amount of ink gradually become lower and hence the drawn lines become thinner as the ink is consumed for writing. To deal with this, the capillary capacity of the sliver may be set to be low so as to smoothly deliver the ink from the sliver. However, this setting will increase the occurrence of ink eruption from the sliver and smudging clothes due to impacts such as from being dropped. In contrast, if the capillary capacity of the sliver is increased, there occurs an ink ejection problem in that the ink flow rate sharply lowers as the ink is used for writing and the drawn line becomes considerably thin in the latter half of the pen's life even though there is still an abundant amount of ink left.

In order to solve the drawbacks of the oil-based ball-point pen and sliver type writing implement described above, a so-called direct ink storage type writing implement using a collector(to be referred to hereinbelow as a collector type writing implement) has been known. This collector type writing implement, as shown in FIG. 1, has an ink tank 3 for directly storing ink 2 arranged in the rear half and mechanism, which has been used in fountain pens, for adjusting the inner pressure by air replacement during writing, using a collector 6 having many retaining grooves 13 defined by vanes(thin plates). A collector type writing implement has advantages that it delivers ink 2 at a flow rate equal to or above that of a sliver type writing implement at the starting stage and will not reduce its ink flow rate and is able to provide thick lines even without applying any extra writing force until its life's end(inkend). However,since the writing implement of this type needs a greater amount of ink as the load than the oil-based ball-point pen, it has a large-diametric ink tank 3 holding a relatively large amount of ink 2(typically about 1 to 3 cc).

In the collector type writing implement, ink 2 moves between collector 6 and ink tank 3 (or air comes in and out through a narrow ink channel 14) when the atmospheric pressure varies, so as to adjust the internal pressure whereby ink 2 will not leak out from the tip, designated at 9, of a point assembly 1.

In this collector writing implement, generally a cap 17 which hermetically seals both the air hole, designated at 10, and point assembly 1, by its having annular undercut shaping is provided in order to prevent evaporation of ink 2. However, this cap 17 has a drawback called pumping phenomenon that the internal pressure within cap 17 will change when this cap 17 is put on and off, to thereby cause ink 2 to gradually fill up the collector 6 and at last ink 2 will flow out from air hole 10 exceeding the collector's retaining limit.

Further, the collector typewriting implement has another drawback that ink eruption which is attributed to the same mechanism as above, occurs with repeated increase and decrease in pressure due to temperature variations, changes pressure in airplane, difference in elevation or the like. It is possible to solve the pumping phenomenon by providing a movable inner cap 18 for cap 17 or by providing a seal face of a rubber end face(not shown), or some other manipulation. On the other hand, in order to solve the eruption problem due to repeated increase and decrease in atmospheric pressure, it is necessary to enlarge the maximum ink retaining capacity of collector 6 (enlarge the diameter or length of the collector) or to reduce the volume of ink tank 3. However, enlargement of the barrel size makes its appearance unstylish, reduction of the ink stored in ink tank 3 makes the pen's life short and hence degrades its cost performance. With a too long collector 6, the ink head at tip 9 of point assembly 1 would become too high, easily causing forward leakage. If the above problem is tried to be solved by modifying ink 2, an ink with markedly poor wettability should be adopted compromising the writing comfort.

If a collector type writing implement which has had cap 17 put on under approximately 1 atm. at the ground level, is carried on an airplane in which the pressure is generally. adjusted to about 0.8 atm., a pressure imbalance will occur. That is, if cap 17 is put off in the airplane, the interior space of the pen at 1 atm., is incidentally exposed to the onboard air of 0.8 atm., so that ink 2 inside rushes through the air channel, designated at 15, inside collector 6 and erupts out from air hole 10 at the front end without ink 2 being able to be retained in retaining grooves 13 of collector 6.

In order to solve this eruption problem originated from pressure imbalance, Japanese Utility Model Publication Hei 3 No.31580 and Japanese Utility Model Publication Hei 3 No.31581 have disclosed devices. In these disclosures, one retaining groove at the middle portion of the collector has two air channels or cutouts symmetrically arranged at different positions on the collector periphery from the air channels of the neighboring retaining grooves, so that the rushing ink will branch into the left and right channels to thereby prevent the ink from directly flowing out through the air hole.

However, with these devices, if ink reaches the vane with two cutouts for the ink retaining groove in question when the internal pressure is adjusted moderately in the normal situation, it becomes impossible to perform air replacement and part of the vane having two cutouts, located opposite the ink channel, becomes unable to retain ink. Resultantly, the retained amount of ink 2 becomes reduced. Further, if only one of the retaining grooves in the middle part has this configuration, ink cannot be retained by the retaining grooves located from that position to the rear of the barrel when a sharp pressure change occurs in an airplane. That is, this configuration is able to lessen the rushing of ink to a certain degree at that site, but cannot retain the whole ink and results in failure to prevent ink from erupting.

It might be considered that such retaining grooves with two cutouts as above can be provided at a number of sites. In this case, however, the above-mentioned part incapable of holding ink also multiplies, so that the retainable volume of ink during moderate adjustment of pressure in the normal situation is reduced. Resultantly, a greater collector may be needed, which leads to the necessity of a large-diametric barrel or reduction in ink load amount which may make the life of the writing implement short.

In order to solve the problem of this ink retaining efficiency, Japanese Patent Application Laid-Open Hei 9 No.104194 offers an invention. In this disclosure, a partitioning plate is provided between the ink channel (called 'air/liquid exchange channel' in the application of the invention but will be referred to here as the ink channel) and the air channel(side channel) to separate one from the other. When inkenters the internal space of the collector(pen core), the ink retaining grooves(collector grooves) are filled with ink gradually in circular direction from one end where the ink channel is located toward the other end.

In the invention of the above disclosure, when the cap is put on and off under circumstances where the ambient pressure varies, ink flushes through the air channel. That is, this configuration has the same problem as the above two devices (disclosed in Utility Model Publication Hei 3 No.31580 and Japanese Utility Model Publication Hei 3 No.31581) or the problem that ink floods out without making efficient use of the retention capacity of the collector.

Further, with the configuration of the above disclosure, if the air channel side is wetted with ink due to rushing ink or ink scattering which may be caused by impacts when the pen is dropped, most of the retaining grooves become sealed by ink from both sides, the narrow vertical groove side, i.e., ink channel side and the air channel side because the retaining grooves are configured so as to allow ink to flow in only one direction when they hold ink. Thus, the air channel is blocked by the ink so that proper replacement of air in the retaining grooves cannot be performed. This means that the collector cannot provide the function as the adjustor any longer, easily causing eruption and forward leakage.

When the above-described writing implement shown in FIG. 1 is put under circumstances where the ambient pressure varies, a strong pressure may act inside the point assembly 1 so that ink 2 may leak forwards from tip 9 of point assembly 1, beside the rushing of ink 2 into collector 6. Therefore, there has been a demand for a device which avoids the pressure inside point assembly 1 directly acting on tip 9 of the writing point when the ambient pressure varies.

It is a primary object of the present invention to improve a prevalent, collector type writing implement, and provide a collector for a writing implement which meets the demand for improvement in deficiency prevention performance such as the capability of preventing ink leakage from occurring due to influence of the ambient pressure being varied during usage or when its cap is put on and off, the capability of preventing ink from erupting or leaking forward when the implement has been stored at a shop for a long period, and which still provides smooth writing comfort during writing. In particular, the object of the present invention is to prevent drawbacks such as ink eruption, which would be caused by repeated increase and decrease in pressure such as repeated flights of airplane whilst meeting the demands for a slim appearance of a collector type writing implement which is liable to be thick, without compromising excellent writing comfort of the conventional collector type writing implement and without increasing the cost.

DISCLOSURE OF INVENTION

According to the present invention, a writing implement collector for adjusting the internal pressure of a writing implement having a point assembly with a writing point at the tip thereof, an ink tank for storing a relatively low viscosity ink, and a feeder means for feeding ink from the ink tank to the writing point, the collector comprising: a multiple number of plate-like elements defining ink retaining grooves therebetween; an ink channel extending through the multiple number of plate-like elements in the axial direction of the collector for connecting the ink retaining grooves; an air channel defined by the arrangement of the multiple number of plate-like elements with cutouts or slots, wherein ink is introduced through the ink channel by the function of capillary action and temporarily held in the ink retaining grooves while air passage in the axial direction and radial direction is secured by the combination of the air channel and retaining grooves, and is characterized in that the air channel is continuously formed along the collector axis, zigzagging with a multiple number of turns of direction.

In the present invention, the air channel of the first configuration is formed on the side opposite to the ink channel with respect to the axis of the collector.

In the present invention, the air channel of the second configuration is formed on the same side as the ink channel with respect to the axis of the collector.

In the present invention, the air channel of the third configuration is formed on the same side as, and on the side opposite, the ink channel with respect to the axis of the collector.

In the present invention, the air channel is comprised of multiple linear channel parts each extending in the axial direction of the collector but adjacent parts being arranged different angular positions with respect to the axis of the collector while each plate-like element located at the boundary between adjacent linear channel parts has a cutout for defining a connecting groove for establishing communication between the adjacent linear channel parts.

In the present invention, the collector is divided into multiple blocks in the axial direction thereof, each block forming an air channel while each plate-like element located between blocks, excepting the part around the ink channel, have an outside diameter smaller than that of the adjacent plate-like elements so as to form a connecting passage which establishes communication between the air channels of the adjacent blocks.

In the present invention, the air channel is configured by providing only one cutout or slot on the periphery of each plate-like element.

In the present invention, a communication hole for establishing communication with the feeder means is formed in, at least, one ink retaining groove.

In the present invention, the ink tank directly stores therein a relatively low-viscosity ink having a viscosity of 2 to 100 mPa·sec at normal temperature.

Specifically, the writing implement of the present invention is applicable to a ball-point pen having a point assembly with a writing point at the tip thereof and an ink feeder means using capillary action for creating passage of ink from an ink tank to the tip of the writing point, or a felt pen or marker with its ink feed itself serves as a writing point. Arranged between a cup-like ink tank with a bottom and the writing point is a collector, which has a vent slot and air channel connected to the outside, a narrow and long ink channel serving as air/liquid exchanger groove and an appropriate number of retaining grooves defined by vanes (thin plate-like elements) spaced a predetermined distance apart from each other and provides the function of adjusting the internal pressure inside the pen body, by making ink 2 flow in and out of the retaining grooves.

As an effective means of the present invention in order to alleviate ink eruption due to rushing of ink from the ink tank to the collector retaining grooves when a sharp change in temperature or pressure occurs, the first configuration of an air channel is defined by forming cutouts (or slots) at the periphery of the collector on the side opposite to the ink channel (on the opposite side with respect to the axis of the collector) and by making turns of direction at least twice so that adjoining air channel parts are not aligned on one straight line parallel with the axis. Preferably, the air channel is made turning at least three times so that the collector is divided into four blocks A, B, C and D or more.

The configuration, as the air channel of the above first means, where the air channel of the collector is defined by forming one cutout (or slot) only in the half section opposite to the ink channel with respect to the collector axis, is effective in maintaining the collector function even if the air channel is wetted by rushing ink, by making full use of the capability of the retaining grooves. Further, when a collector 106 is formed by injection molding using a plastic, for example, there is no need to change the metal die structure of the metal die for forming the side opposite to an ink channel 114 because air channel 115 needs to be winded in zigzag from one part to another by shaping only the half section as in the conventional configuration. Therefore, it is possible to exactly mold thin fin-like vanes 112 without changing the metal die structure and retaining grooves 113 in the same manner as the prior art without the necessity of extra parts cost.

As another effective means of the present invention in order to alleviate ink eruption due to rushing of ink from the ink tank to the collector retaining grooves when a sharp change in temperature or pressure occurs, the second configuration of an air channel for communication with the outside air is defined so as to wind making multiple turns of direction by forming cutouts(or slots) in the same half side where the ink channel is formed (on the same side with respect to the axis of the collector) at the periphery of the section and by deflecting (connecting) one axial air channel part (215*a*, 215*b*, 215*c*, . . . ) for each block with the adjoining axial air groove using a connecting passage (222*a*, 222*b*, 222*c*. . . ), which is defined by a plate-like element having an outside diameter smaller than that of the adjacent vanes so that the adjoining air channel parts are not aligned on one straight line parallel with the axis. Preferably, the air channel is made zigzag(winding) at least three times so that the collector is divided into four blocks A, B, C and D or more(see FIG. 9 for example).

The plate-like elements defining the connecting passages (222*a*, 222*b*, 222*c*) at their periphery are made smaller in diameter than the adjacent plate-like elements (vanes) so as to create an air channel along almost full circumference. This configuration is effective in maintaining the collector function even if the air channel is wetted by rushing ink, by making full use of the capability of the retaining grooves. Further, when the collector is formed by injection molding using a plastic, for example, the pattern needs to be formed only on the same side of the ink channel of the collector, therefore the metal die of the half side on the side opposite to the ink channel is easily formed. Therefore, it is possible to exactly mold thin fin-like vanes without changing the metal die structure and retaining grooves in the same manner as the prior art without the necessity of extra parts cost.

As still another effective means of the present invention in order to alleviate ink eruption due to rushing of ink from the ink tank to the collector retaining grooves when a sharp change in temperature or pressure occurs, the third configuration of an air channel for communication with the outside air is defined so as to wind making multiple turns of direction by forming each block with cutouts (or slots) (315*a*, 315*b*, 315*c* . . . ) and arranging the cutouts alternately at the position in proximity to the ink channel and at the position on the side opposite to the ink channel with the center of the ink channel in between, and by deflecting at least twice (connecting) one axial air channel part (315*a*, 315*b*, 315*c*, . . . ) for each block with the adjoining axial air channel parts using a connecting passage (322*a*, 322*b*, 322*c* . . . ) which is defined by a plate-like element having an outside diameter smaller than that of the adjacent vanes so that the adjoining air channel parts are not aligned on one straight line parallel with the axis. Preferably, the air channel is made turning(winding) at least three times so that the collector is divided into four blocks A, B, C and D or more.

Further, the configuration of the present invention, in which a communication hole for establishing communication with the intermediate cores 7 and 8 is formed in, at least, one ink retaining groove, is able to prevent ink seepage from the writing point under a varying pressure situation. If the size Tr of the conduit hole is too small, there occurs the risk that ink may be sucked from the interior to the retaining groove side because of capillarity imbalance. Therefore, the conduit hole preferably has a dimension greater than the width t of the smallest retaining groove (Tr>t).

Here, the components used in the present invention may be conventionally publicly known items. For example, as the ink, a pseudo-plastic ink (also called gel ink) which has a low (or medium) viscosity of 2 to 100 mPa·sec at normal temperature (about 23° C.) and presents a rather high viscosity in the static state so as to prevent forward leakage of ink from the tip of the point assembly and lowers its viscosity when affected by shearing force or movement while writing so as to enable smooth writing, may be used by modifying it to have a lower viscosity to some degree. A typical solvent as the base of the ink is water but organic solvent such lower alcohols, higher alcohols, xylene, etc., glycols such as ethylene glycol, and their esters, which are publicly known as usable for collector type writing implements, may be used as appropriate for the ink.

Similarly, for other components, conventionally used items can be selected as appropriate, such that the ink feeder means for the center core (serving as a writing point in the case of a felt pen or marker) may be of a fiber bundle core made up of fabric threads shaped by heat or adhesives, of a plastic core formed by extrusion molding having a snow-crystal section, of a sintered core made up of small particles with spaces or pores therein, thermally fixed or bonded with adhesives, or of a sponge, as long as it is capable of holding and leading ink to a certain degree or more.

BEST MODE FOR CARRYING OUT THE INVENTION

In order to explain the present invention in detail, the embodiments of the present invention will be described with reference to the accompanying drawings.

Figure 1:
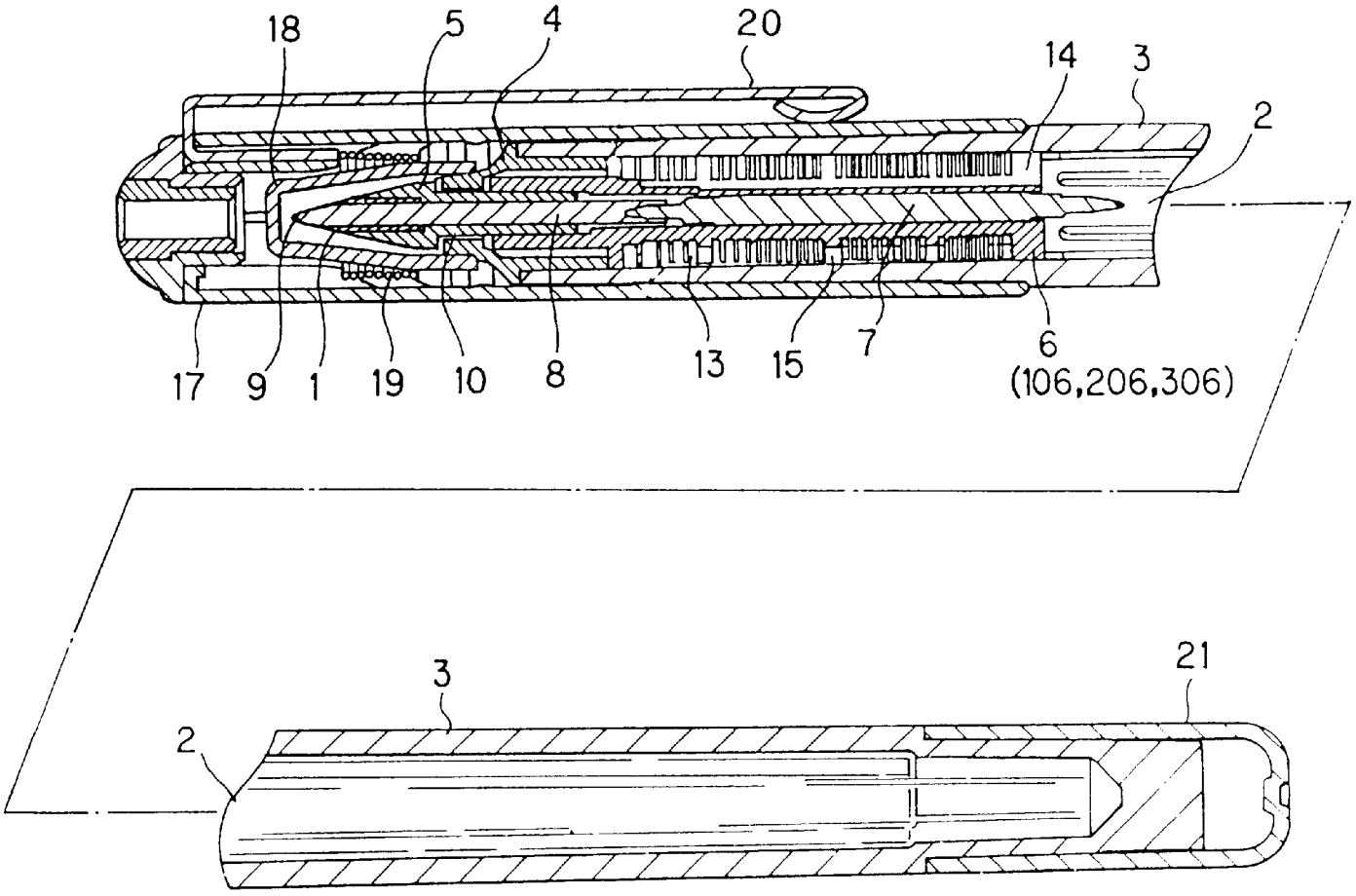
FIG. 1 is a vertical sectional view showing a typical collector type writing implement.

FIGS. 2 through 8 are views for illustrating a collector for a water-based ball-point pen in accordance with the first embodiment. FIG. 1 shows a collector type ball-point pen to which the collector of the embodiment is applied.

As shown in FIG. 1, a typical collector type ball-point pen is comprised of a point assembly 1 which loosely holds a writing ball 9 at its tip so that the ball can rotate but will not fall off, a collector 106(collectors 206 and 306 in the second and third embodiments are also arranged in the same manner as in FIG. 1) held in the body barrel cylinder and an ink tank 3 which is the space inside the barrel cylinder partitioned by the rear end of collector 106. A collector core 7 and center core 8 are arranged inside, and penetrated through, collector 106(hollow portion) so as to feed ink 2 to ball 9 from the ink tank 3. Other parts including a tail plug 21, clip 20, cap 17, cap sealing mechanism for providing an anti-pumping function by actuating an inner cap 18 with a spring 19, a point assembly 1 holder(so-called plastic mouthpiece) 5 for creating an air channel between collector 106 and point assembly 1 and providing color indication and a joint 4 are configured as appropriate in the same manner as in conventional products.

Ink tank 3 is made up of a transparent or translucent synthetic resin and directly stores therein a relatively low-viscosity ink 2 containing more than 40% of water as its base and having a viscosity of 2 to 100 mPa·sec at normal temperature. Collector 106 is press fitted into the barrel cylinder so that ink will not leak from this ink tank 3. Concerning ink 2 stored in ink tank 3 and used for writing, there are dye inks which are soluble in a main solvent and pigments such as carbon black and pseudo-organic pigments such as dye resin powders as coloring agents that present beneficial water resistance and light resistance. Ink 2 used in the conventional collector type writing implements can also be used. That is, the ink is not particularly limited in the present invention. An ink which is dissolved in a main organic solvent such as alcohols, xylene, etc., may be applied to the present invention as long as it can provide the functions of a collector type writing implement.

Particularly, when ink has been used by ink consumption for writing so the amount of ink 2 left in the ink tank 3 is slightly greater than the amount of the maximum retention of collector 6, the internal pressure inside ink tank 3 tends to vary significantly. If a change of the internal pressure relative to the ambient pressure occurs due to variation in atmospheric pressure or if a change of the internal pressure occurs due to variation in ambient temperature, ink 2 may leak out from tip 9 of point assembly 1 because a channel of ink 2 for writing is established. Alternatively, air may enter through tip 9 to cause ink starving. In order to prevent these deficiencies, communication between the interior of the barrel cylinder and the outside is established by providing collector 106 having a fine enough ink channel 114 forming an air-liquid replacement groove, an air channel 115 (formed of parts 115*a*, 115*b*, 115*c* and 115*d*) and multiple number of vanes 112 arranged at intervals defining retaining grooves 113. The collector 106 functions to balance the internal pressure when a difference in pressure occurs between the atmosphere and the interior of the ball-point pen (mainly the interior of ink tank 3) arises, by varying the air volume inside the ball-point pen body or by retaining grooves 114 defined by the vanes of collector 106 holding ink 2 therein or releasing ink 2 therefrom.

The total volume of retaining grooves 113 capable of holding ink 2 therein in collector 106 was specified to be equal to or greater than 12% of the volume of ink tank 3 (preferably 15% to 30%). The dimensions of collector 106 as well as the groove width etc., may be specified as appropriate depending on ink 2 used, the volume of ink tank 3 and others. The greater the size of collector 106, the more improved the collector performance against ink leakage. However, if the ink tank volume (ink 2 load amount) is secured by enlarging collector 106, the entire pen size becomes greater. Alternatively, if the pen size is not varied significantly, the volume of the ink tank 3 should be reduced in proportion to the enlargement of collector 106, causing the problem that the load amount of ink 2 is low compared to the size of the entire pen body. Therefore, these dimensions are usually specified optimally to a certain degree.

Figure 2:
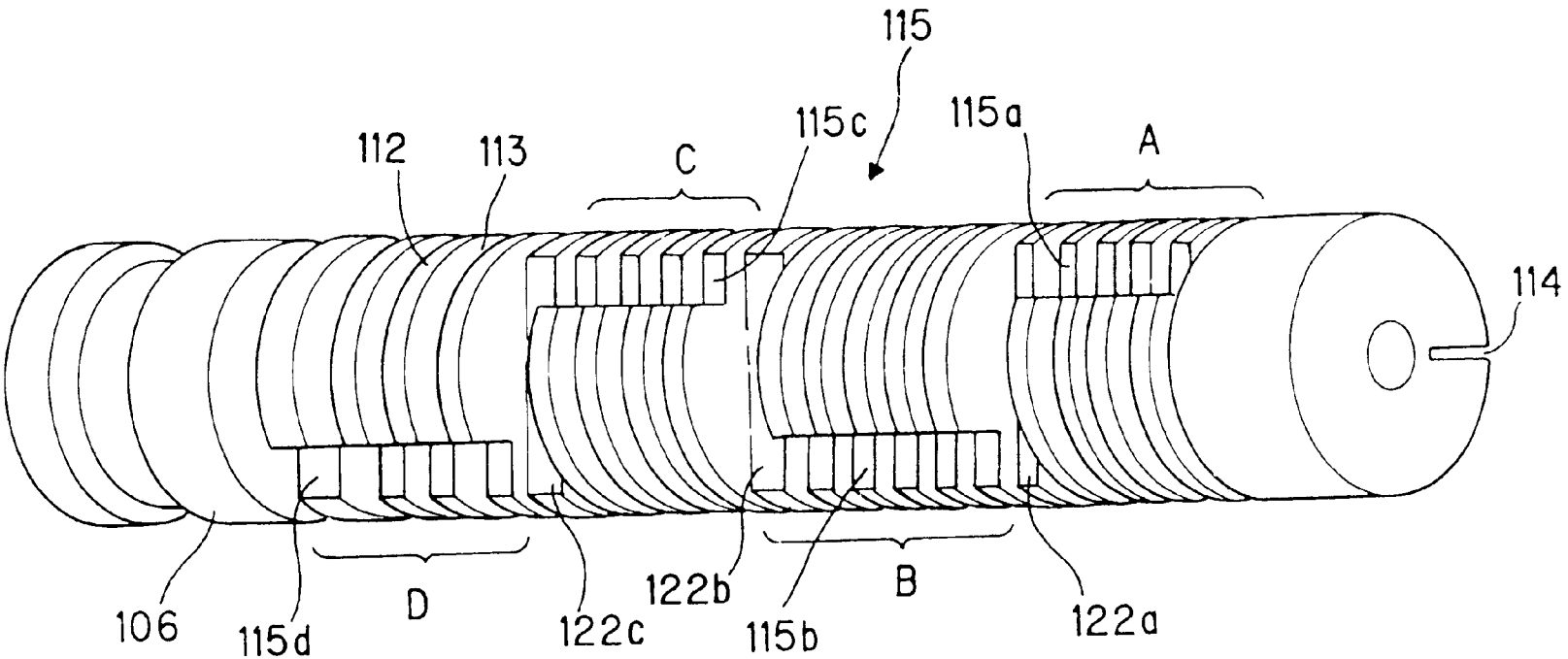
FIGS. 2 through 8 are views for illustrating a collector of the first embodiment, FIG. 2 being a perspective view showing the collector, FIG. 3 being a front external view showing the collector, FIG. 4 being a rear-side external view showing the collector, FIG. 5 being a sectional view showing the collector cut along an E—E plane in FIG. 3, FIG. 6 being a sectional view showing the collector cut along an F—F plane in FIG. 3, FIG. 7 being a sectional view showing the collector cut along a G—G plane in FIG. 3, FIG. 8 being a sectional view showing the collector cut along an H—H plane in FIG. 3.
Figure 3:
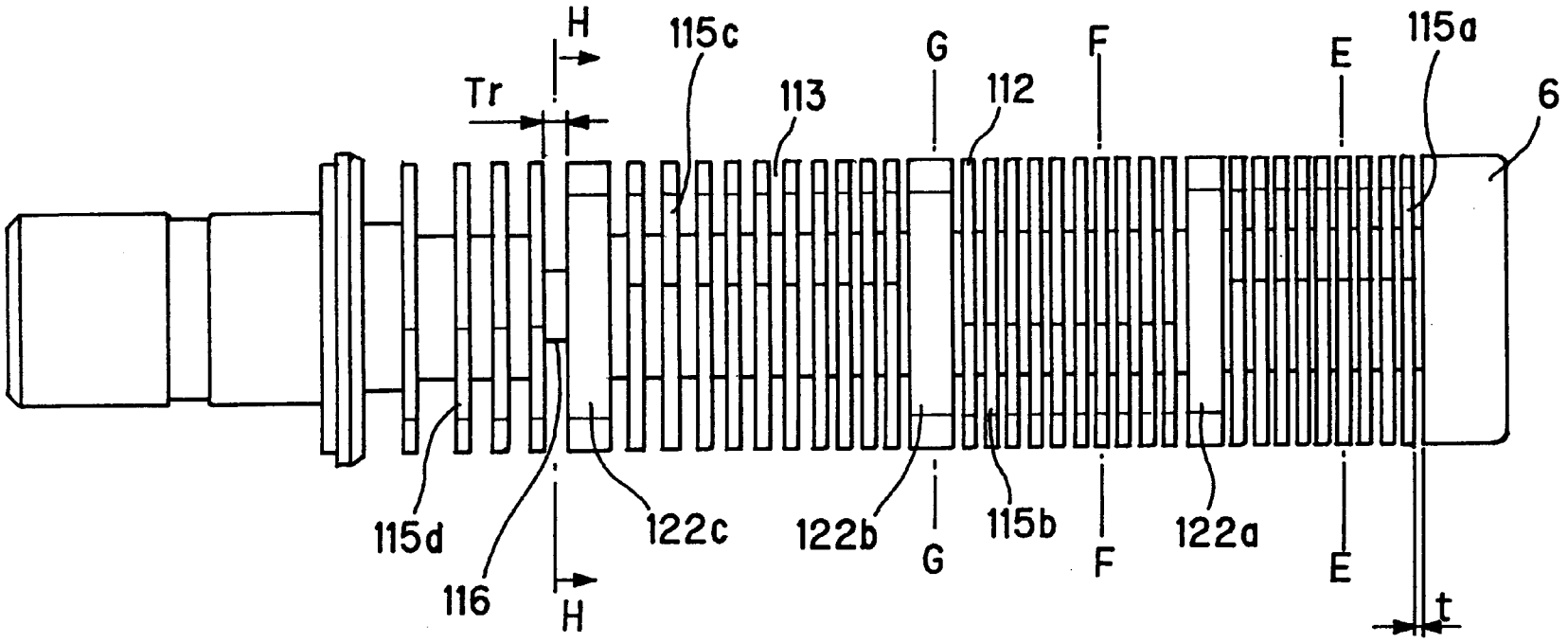
Figure 4:
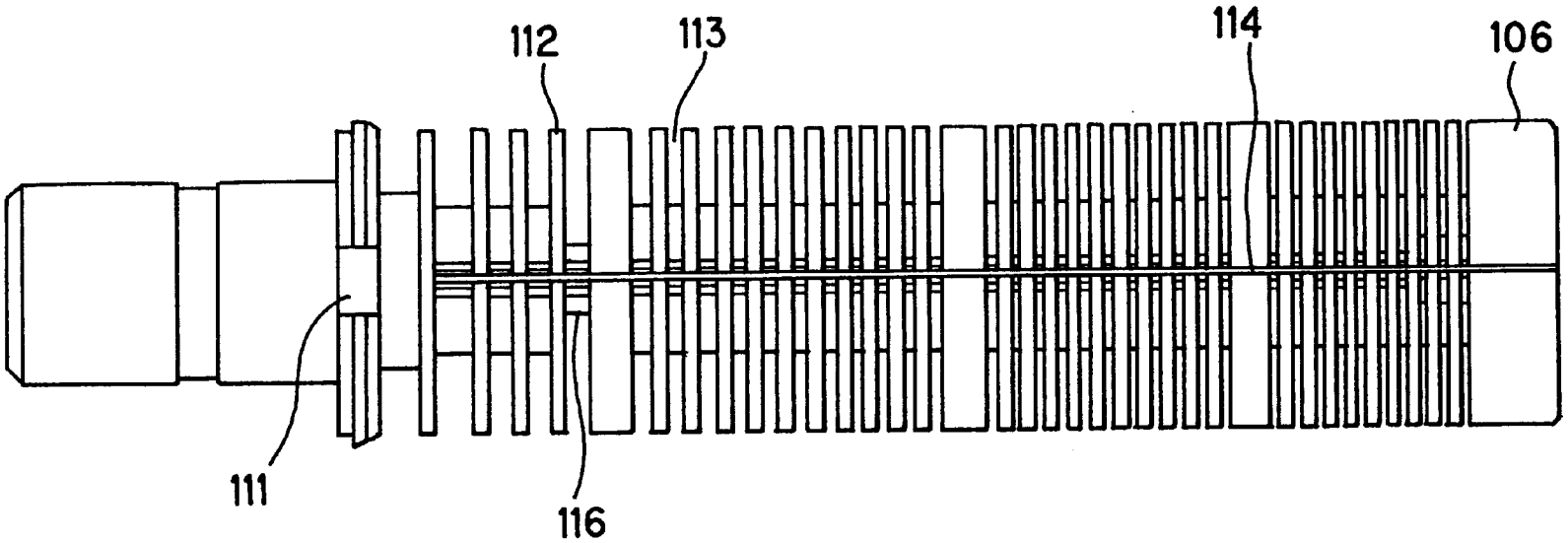

FIGS. 2 to 8 show a configurational example(the first embodiment) of an effective collector of the present invention. FIGS. 2 to 4 are overall views of the collector and FIGS. 5 to 8 are sectional views at different positions.

In general, the air channel is formed with a straight configuration extending in the axial direction. In the first embodiment an air channel 115 for allowing air to pass therethrough in the collector is defined by shaping a series of vanes 112 with cutouts or slots so as to form a continuous air channel in the axial direction of collector 106, as sectionally shown in FIGS. 5 to 7. This air channel 115 is sectioned into parts such as a linear channel part 115*a*, linear channel part 115*b*. That is, air channel 115 is made up of linear parts 115*a*, 115*b*, 115*c* and 115*d* adjacent to each other as shown in FIGS. 2 and 3 so that these parts are not aligned but the passage is formed to zigzag at least twice (preferably three times (115*a*, 115*b* and 115*c*) or more) within collector 106. The changes of direction are preferably allocated over the full length of retaining grooves 113 of collector 106. However, it was found that the same effect could be obtained even when the changes of direction were arranged to the rear or front side with respect to the axial direction.

Figure 5:
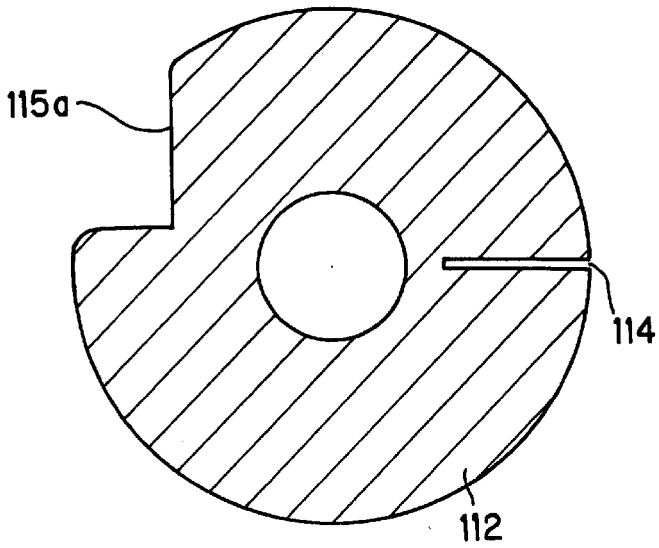
Figure 6:
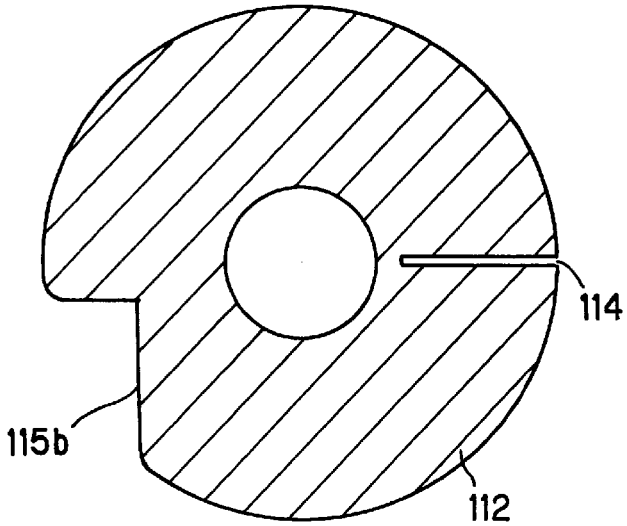
Figure 7:
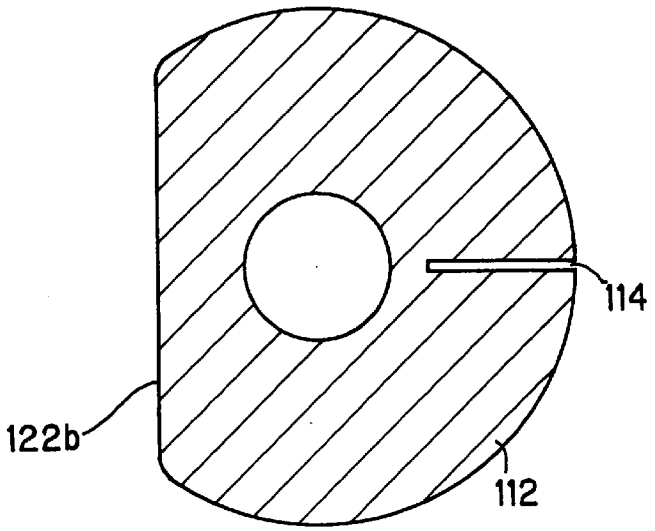

Detailedly, air channel 115 of collector 106, as is understood from FIGS. 3 to 5, is disposed on the side opposite to ink channel 114 with respect to the axial center of collector 106. As illustrated, the air channel 115 is comprised of linear channel parts 115*a*, 115*b*, 115*c* and 115*d*, each extending parallel to the axis of collector 106, and each part is arranged at a different angular position, with respect to the axis of the collector, from that of the adjacent parts. Further, these blocks of linear channel parts 115*a*, 115*b*, 115*c* and 115*d* are partitioned by plate-like elements (i.e., relatively thick partition walls or vanes 112) which each have a cutout 122*a*, 122*b* and 122*c* on their periphery to connect two adjoining linear channel parts of 115*a*, 115*b*, 115*c* and 115*d*. In linear channel parts 115*a* to 115*d*, each vane is formed with an L-shaped cutout as shown in FIGS. 5 and 6 while connecting cutouts 122*a* to 122*c* are cut along a chord as shown in FIG. 7. Here, a reference numeral 111 designates a vent channel at the front part of collector 106.

Figure 9:
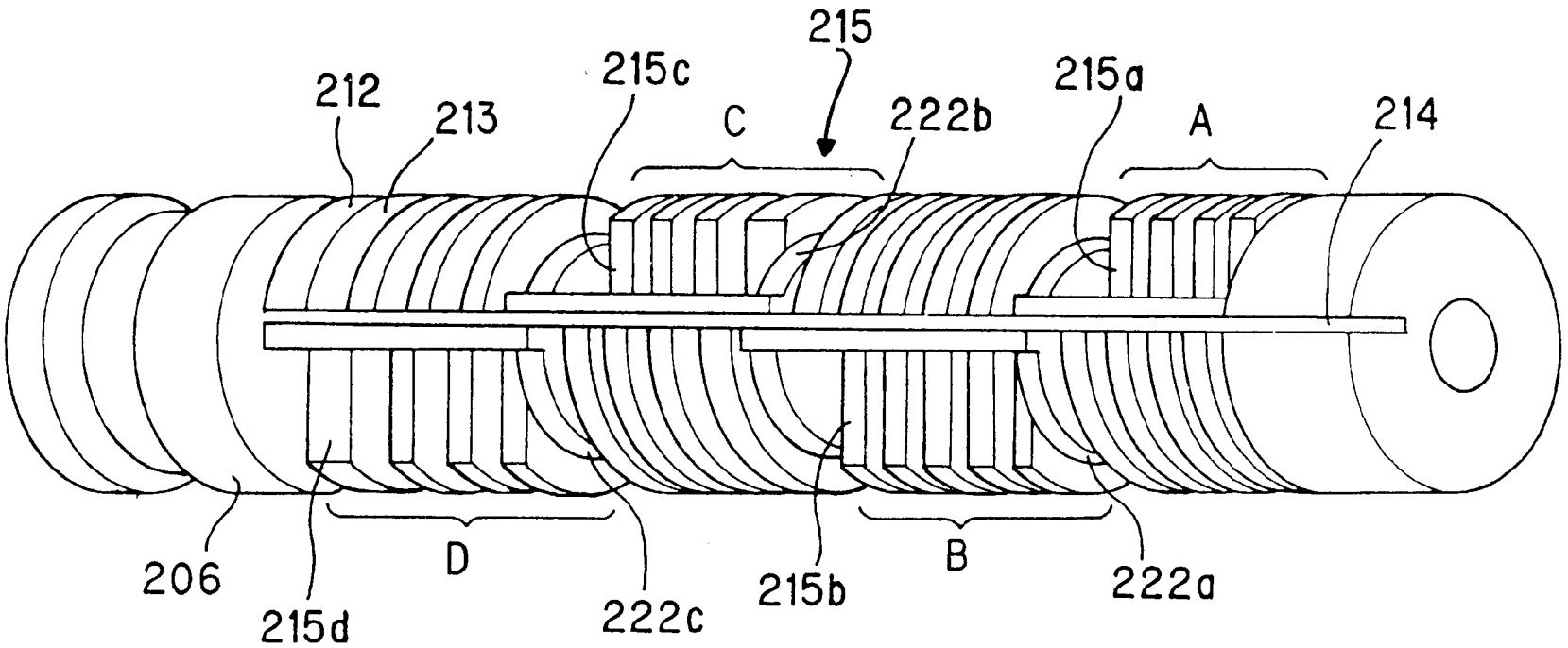
FIGS. 9 through 14 are views for illustrating a collector of the second embodiment, FIG. 9 being a perspective view showing the collector, FIG. 10 being a front external view showing the collector, FIG. 11 being a sectional view showing the collector cut along an E—E plane in FIG. 10, FIG. 12 being a sectional view showing the collector cut along an F—F plane in FIG. 10, FIG. 13 being a sectional view showing the collector cut along a G—G plane in FIG. 10, FIG. 14 being a sectional view showing the collector cut along an H—H plane.
Figure 10:
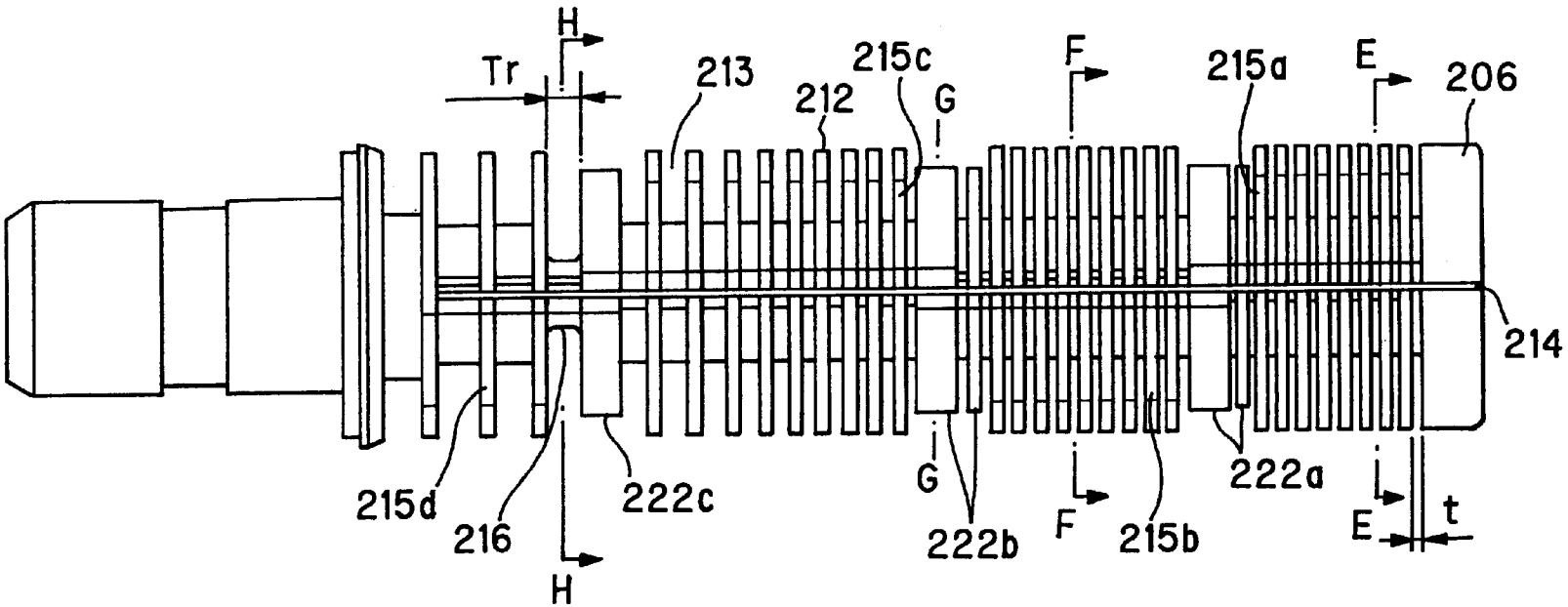
Figure 11:
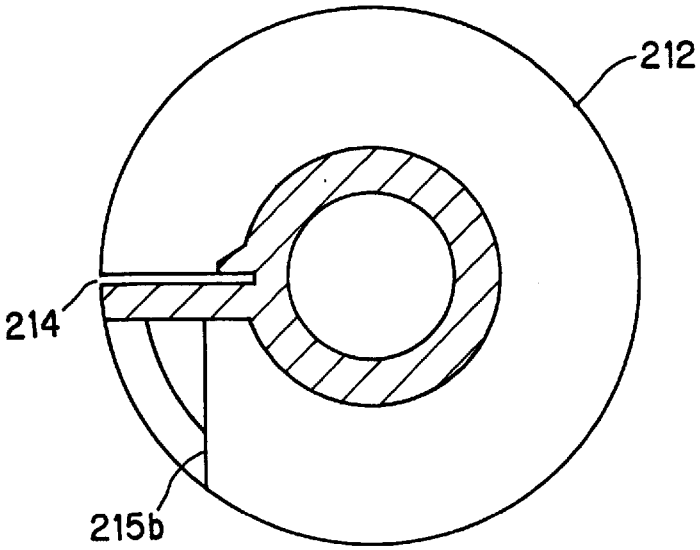
Figure 12:
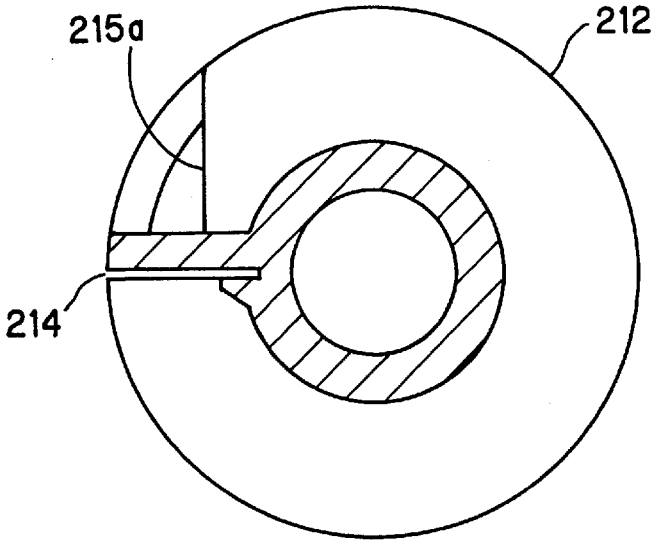

Next, FIGS. 9 to 14 shows a configurational example (the second embodiment) of another effective collector of the present invention. FIGS. 9 and 10 are overall views of the collector and FIGS. 11 to 14 are sectional views at different positions.

In general, the air channel is formed with a straight configuration extending in the axial direction. In the second embodiment an air channel 215 (formed of parts 215*a*, 215*b*, 215*c* and 215*d*) for allowing air to pass therethrough in the collector is defined by shaping a series of vanes 212 with cutouts or slots so as to form a continuous air channel in the axial direction of the collector 206, as sectionally shown in FIGS. 11 and 12. This air channel 215 is sectioned into parts such as a linear channel part 215*a*, linear channel part 215*b*. That is, air channel 215 is made up of linear parts 215*a*, 215*b*, 215*c* and 215*d* adjacent to each other as shown in FIGS. 9 and 10 so that these parts are not aligned by the passage is formed to zigzag at least twice (preferably three times (215*a*, 215*b* and 215*c*) or more) in collector 206. In this case, collector 206 is divided into multiple blocks A, B, C and D in the axial direction, and these blocks A, B, C and D form respective air channel parts 215*a*, 215*b*, 215*c* and 215*d* in this order in the axial direction. Interposed between the adjacent blocks are plate-like elements which, excepting the part around the ink channel, designated at 214, have an outside diameter smaller than that of vanes (plate-like elements) 212, forming connecting passages 222*a*, 222*b* and 222*c* in the periphery thereof. These connecting passages 222*a*, 222*b* and 222*c* connect and are offset to one to the next with respect to the air channel parts 215*a*, 215*b*, 215*c* and 215*d*. The changes of direction are preferably allocated over the full length of retaining grooves 213 of collector 206. However, it was found that the same effect could be obtained even when the changes of direction were arranged to the rear or front side with respect to the axial direction. Here in the collector 206, a reinforcing wall is formed on the air channel 215 side next to the ink channel 214 (see FIGS. 11 and 12).

Figure 15:
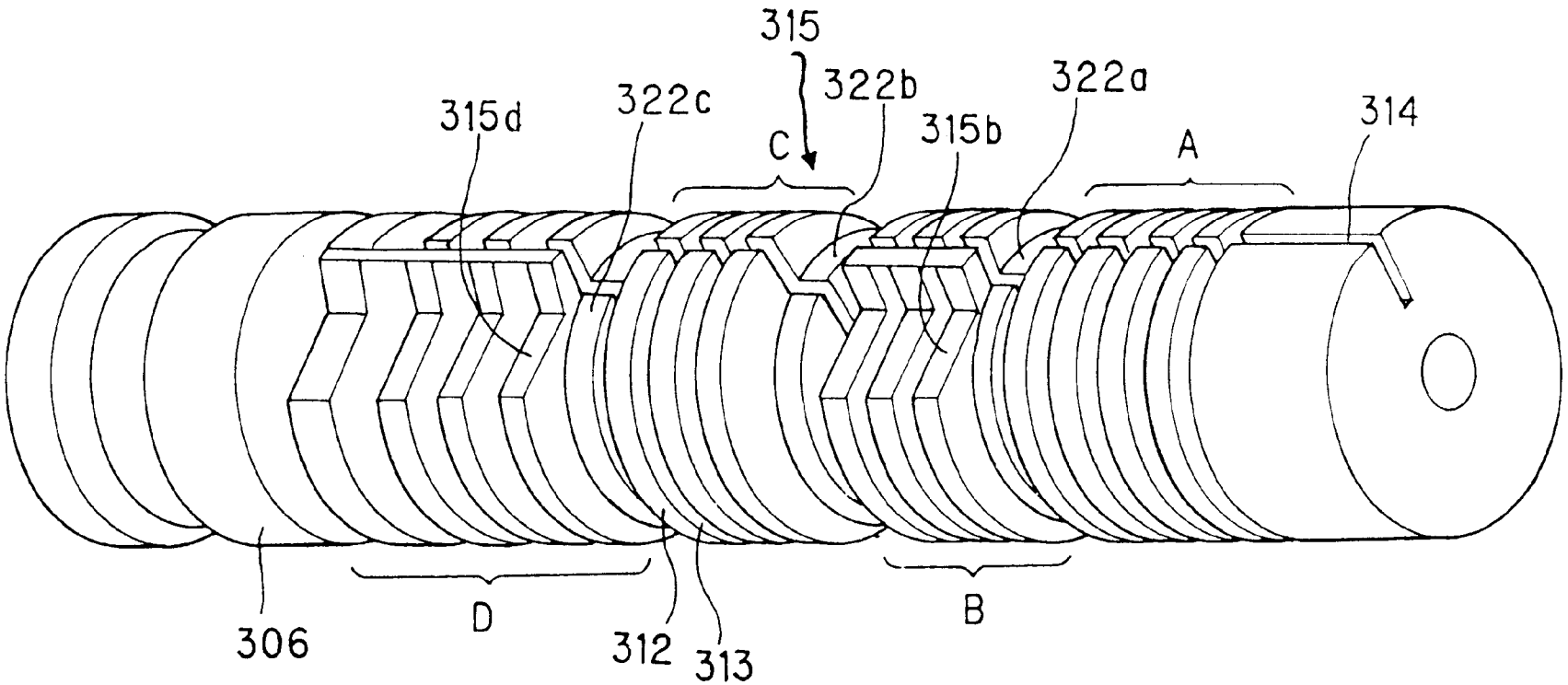
FIGS. 15 through 22 are views for illustrating a collector of the third embodiment, FIG. 15 being a front perspective view showing the collector, FIG. 16 being a rear-side perspective view showing the collector, FIG. 17 being a front external view showing the collector, FIG. 18 being a rear-side external view showing the collector, FIG. 19 being a sectional view showing the collector cut along an E—E plane in FIG. 17, FIG. 20 being a sectional view showing the collector cut along an F—F plane in FIG. 17, FIG. 21 being a sectional view showing the collector cut along a G—G plane in FIG. 17, FIG. 22 being a sectional view showing the collector cut along an H—H plane in FIG. 17.
Figure 16:
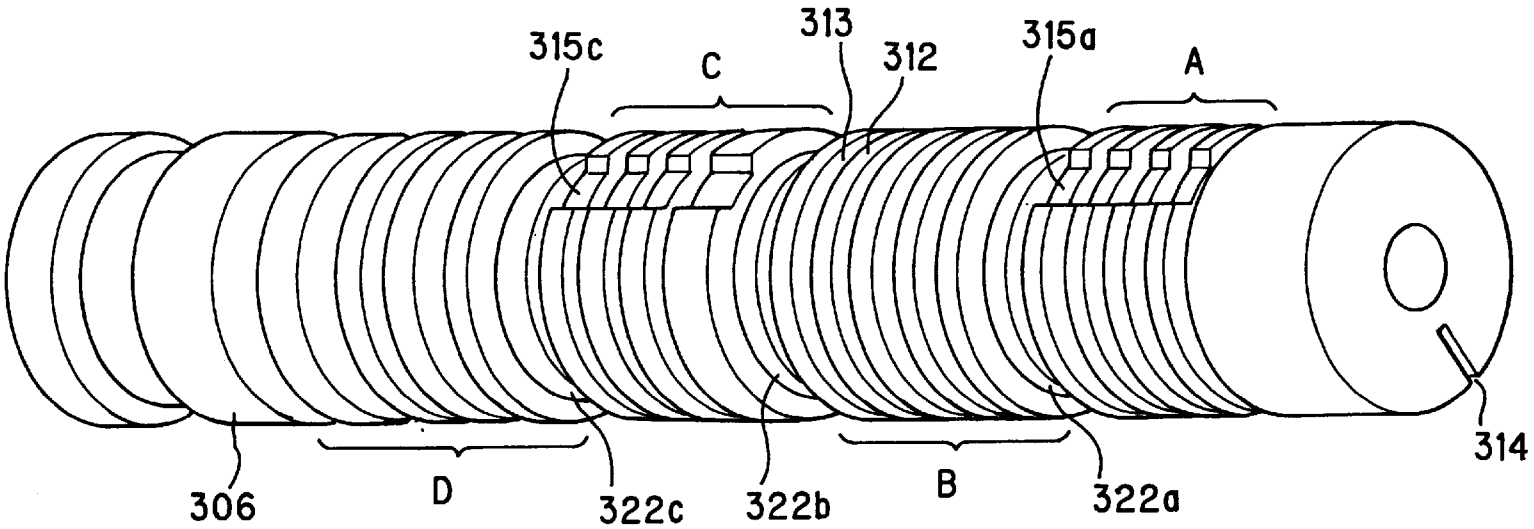
Figure 17:
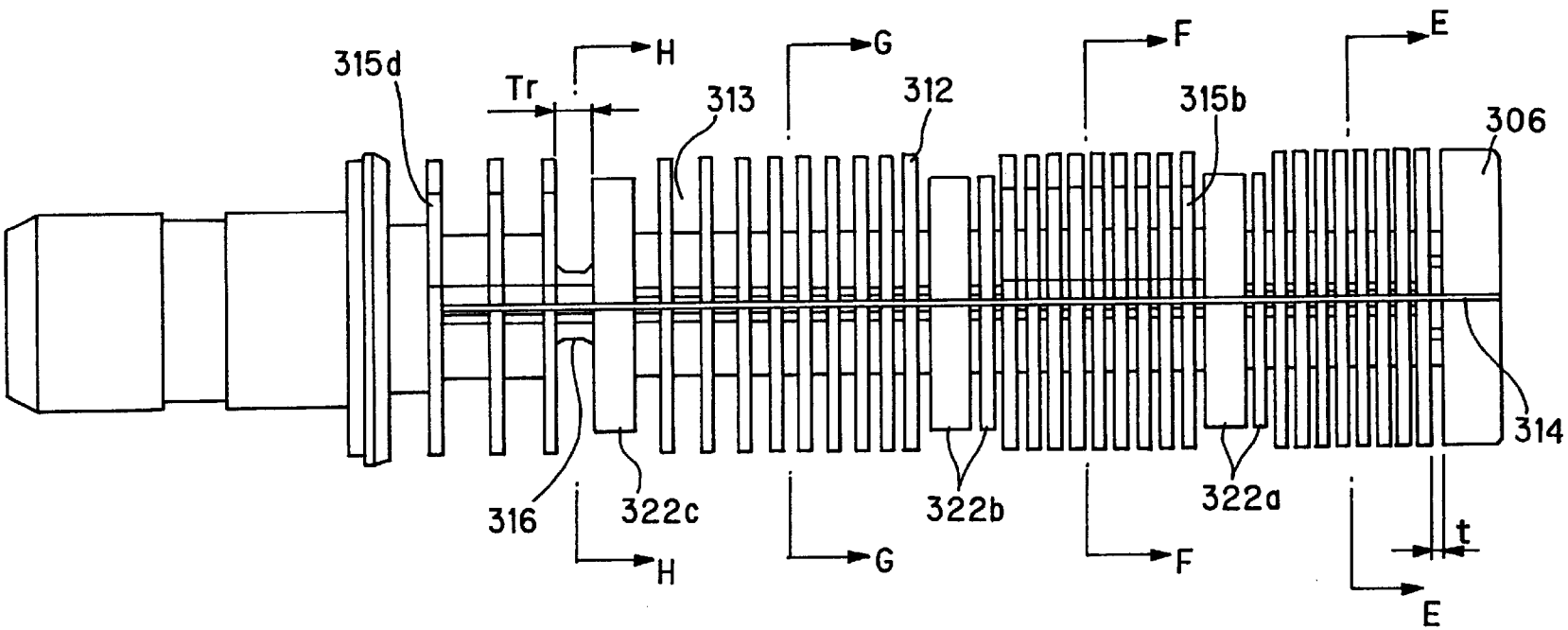
Figure 18:
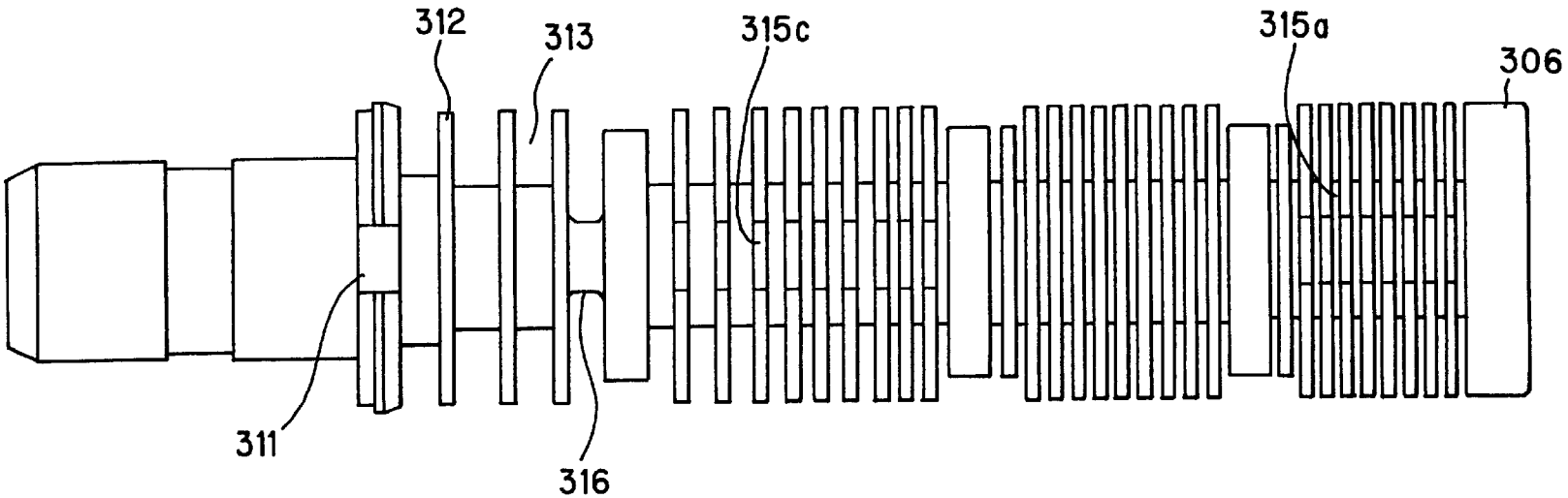
Figure 19:
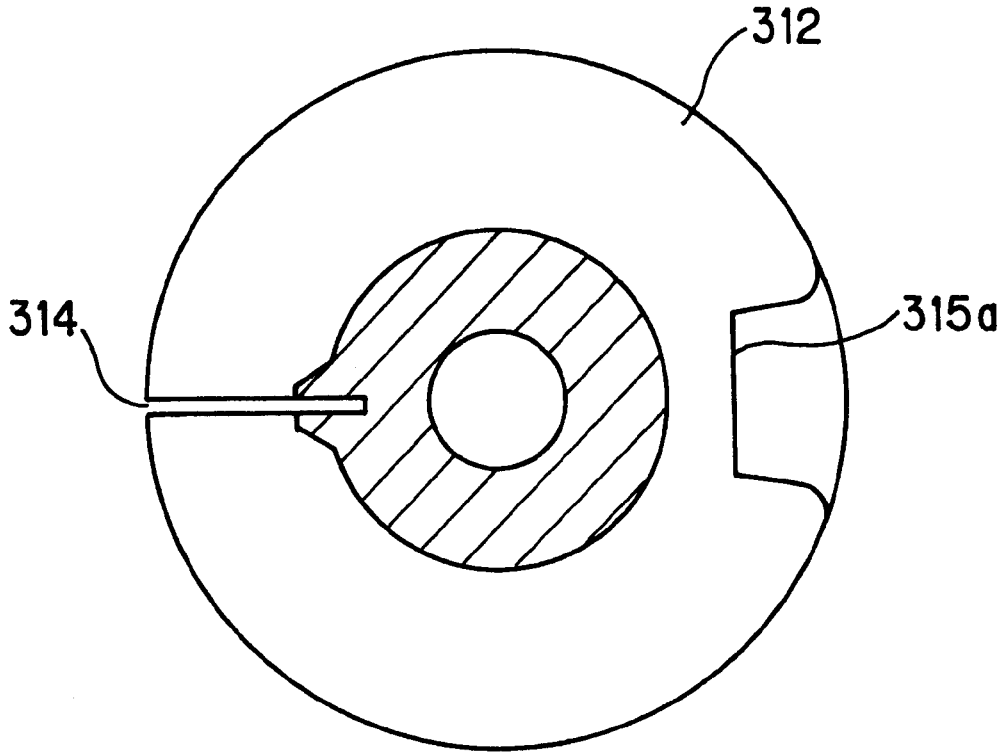
Figure 20:
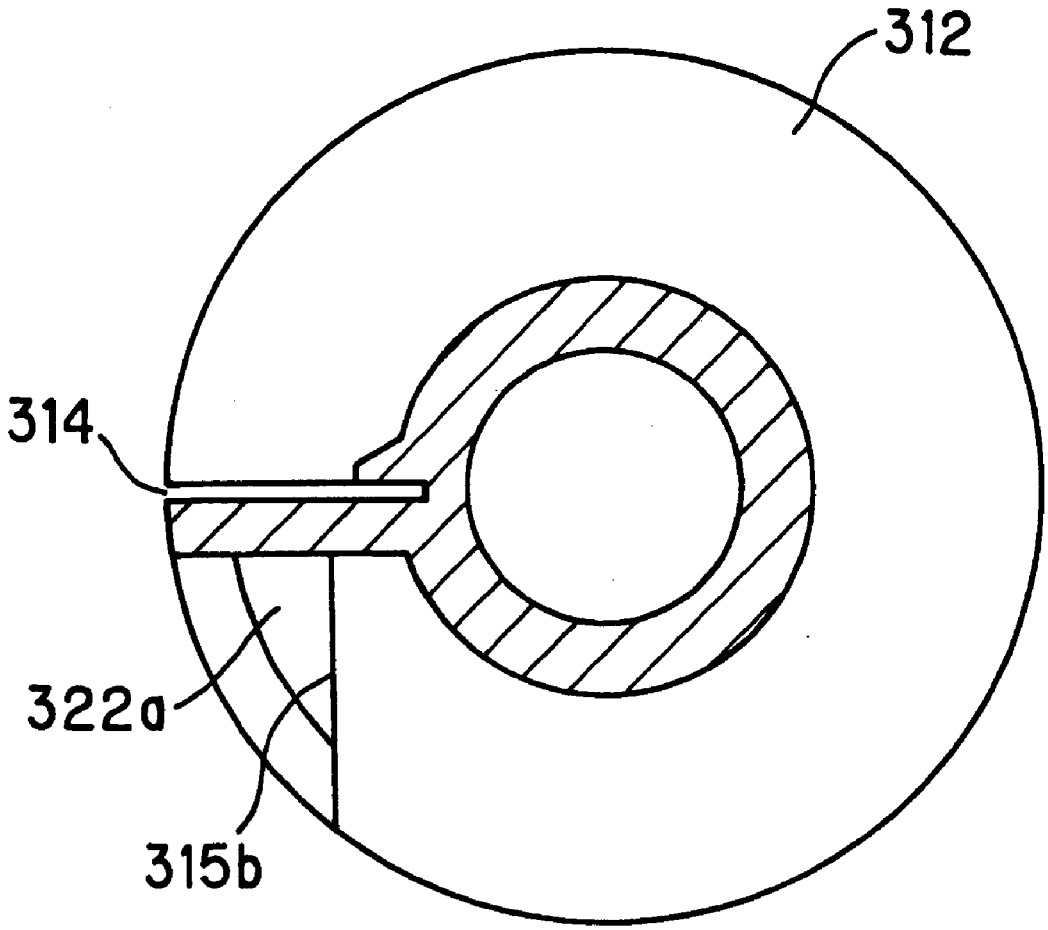
Figure 21:
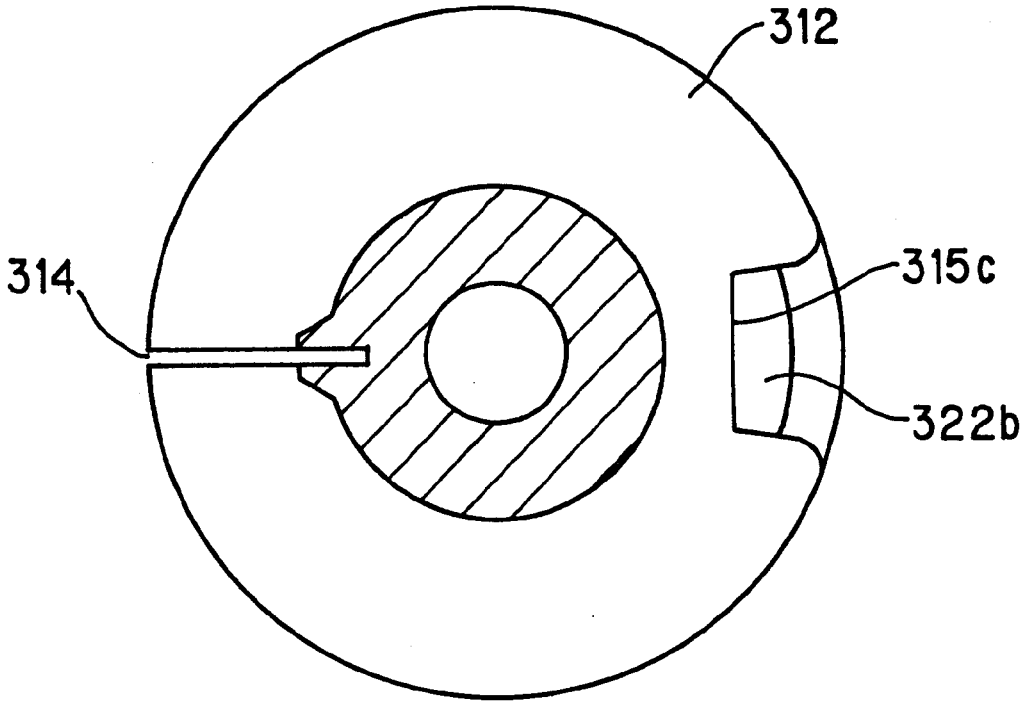

Next, FIGS. 15 to 22 shows a configurational example (the third embodiment) of still another effective collector of the present invention. FIGS. 15 to 17 are overall views of the collector and FIGS. 18 to 22 are sectional views at different positions.

In general, the air channel is formed with a straight configuration extending in the axial direction. In the second embodiment an air channel 315 (formed of parts 315*a*, 316*b*, 315*c* and 315*d*) for allowing air to pass therethrough in the collector is defined by shaping a series of vanes 312 with cutouts or slots so as to form a continuous air channel in the axial direction of the collector 306, as sectionally shown in FIGS. 19, 20, 21 and 22. This air channel 315 is sectioned into parts such as a linear channel part 315*a*, linear channel part 315*b*. That is, air channel 315 is made up of linear parts 315*a*, 315*b*, 315*c* and 315*d* adjacent to each other as shown in FIGS. 9 and 10, by arranging them alternately at the position in proximity to the ink channel, designated at 314 and at the position on the side opposite to the ink channel, so that these parts are not aligned or penetrated through but the passage is formed to wind in zigzag at least twice (preferably three times (315*a*, 315*b* and 315*c*) or more) in collector 306. In this case, collector 306 is divided into multiple blocks A, B, C and D in the axial direction, and these blocks A, B, C and D form respective air channel parts 315*a*, 315*b*, 315*c* and 315*d* in this order in the axial direction. Interposed between the adjacent blocks are plate-like elements which, excepting the part around the ink channel, designated at 314, have an outside diameter smaller than that of vanes (plate-like elements) 312, forming connecting passages 322*a*, 322*b* and 322*c* in the periphery thereof. These connecting passages 322*a*, 322*b* and 322*c* connect and are offset to one to the next with respect to the air channels 315*a*, 315*b*, 315*c* and 315*d* of adjacent blocks, thus forming collector 306. The changes of direction are preferably allocated over the full length of retaining grooves 313 of collector 306. However, it was found that the same effect could be obtained even when the change of direction were arranged to the rear or front side with respect to the axial direction. Here, in the collector 306, a reinforcing wall is formed on the air channel 315 side next to the ink channel 314 (see FIG. 20).

In the conventional collector type writing implement, internal pressure adjustment up to about 12% is made so as to deal with relatively gentle change in internal pressure due to temperature change etc., by only the collector as stated above. However, as to conventional collector type writing implements, careful consideration has not been given for the use of the writing implement under a reduced pressure state in an airplane. Since the collector 6 does not have the capability of retaining ink 2 if ink moves in a rush, there is a risk that the inrush of ink 2 might run through air channel 15 and vent channel 11 in collector 6 and erupt from air hole 10 of the pen body.

Next, consideration as to the situation and effect in an airplane will be detailed.

When a ball-point pen which has had cap 17 put on under approximately 1 atm. at the ground level, is carried on an airplane with the pressure adjusted to about 0.8 atm. and the cap is opened, ink 2 rushes into collector 6 or retaining grooves 13 for internal pressure adjustment, in order to balance the internal pressure inside ink tank 3, which has been high or kept at approximately 1 atm. by sealing of inner cap 18, against the low onboard pressure.

When cap 17 is fitted on the ball-point pen after writing use, the internal pressure of about 0.8 atm is kept in a state of equilibrium and will be maintained at that internal pressure by sealing of inter cap 18.

Then, when cap 17 is removed under approximately 1 atm. after returning to the ground, ink 2 retained by collector 6 tends to rush into the ink tank 3 side. However, because of its sharp pressure variation, some air also enters ink tank 3 before and while ink 2 returns to ink tank 3, producing state of ink 2 being left within collector 6. Since collector 6 has been filled with ink 2 at this stage, the pen, particularly, the collector has little margin for adjusting any internal pressure variation due to a slight temperature change or repeated embankment on an aircraft and use therein of the pen, leading to deficiency, i.e., ink eruption.

This deficiency can be reduced by using a cap 17 with no sealing function because a sharp pressure variation does not occur. However, this allows much evaporation of ink 2, causing ink hardening with time or making the ink thicker hence causing ink starving.

On the other hand, if this problem is solved by making the retaining amount of collector 6 greater, the gripping portion, which is already thicker in a collector type writing implement than in others, will become too thick, posing handling and appearance problems. If collector 6 is made longer than the conventional products, ink head equivalent to the length of the collector 6 acts on pen point 2, causing ink 2 to leak forward from tip 9 in the point assembly. If the volume of ink tank 3 is reduced, it is possible to enhance prevention against deficiencies because the retaining ratio becomes greater with the same size of collector 6. However this poses the problem of the writing life. Since direct-feed type writing implements stably provide an ample amount of ink from the starting stage until its writing life end, the same lifetime as pens of a sliver type which gradually reduce their ink consumption as they are used cannot be secured unless the former has a greater initial load amount of ink than the latter.

In contrast to this, in the first embodiment of the present invention, air channel 115 is arranged to wind in zigzag on the side approximately opposite ink channel 114. That is, to lead ink 2 into and retain it in retaining grooves 113, ink flows in and out around ink channel 114 whilst air therearound is released through air channel 15. Therefore, even if air channel 115 and thereabout is wetted with inrush ink 2 to some degree, ink can flow in and out at both sides of ink channel 114, whereby it is possible to reduce a risk of blockage of air circulation which would disturb ink 2 to flow in and out. Thus, the rushing power of ink can be weakened as it goes through the air channel parts 115*a*, 115*b*, 115*c* and 115*d* turning in alternating directions while ink 2 is stored in retaining grooves 113 there along, resultantly pressure increase can be weakened as the ink reaches the front end with respect to the axial direction hence no ink 2 will erupt from vent hole 11.

Since air channel 115 winding in zigzag is arranged on the side approximately opposite to ink channel 114, no air circulation failures which would induce insufficient retention of ink 2 will occur when pressure varies moderately. Therefore, ink 2 can be retained 100% without. any loss even if the air channel has an intricate zigzag configuration while making multiple turns of direction. In particular, the configuration with air channel 115 arranged in a zigzag manner only on the half opposite ink channel 114 is free from the above problem and is also effective in producing its metal die.

In the second embodiment of the present invention, air channel 215 is arranged to wind in zigzag on the same side as ink channel 214. That is, to lead ink 2 into and retain it in retaining grooves 213, ink flows in and out around ink channel 214 whilst air therearound is released through air channel 215. This arrangement is provided for each of blocks A, B, C and D and connecting passages 222*a*, 222*b* and 222*c* are provided as the air passage for connecting these blocks. When ink 2 rushes in due to a sharp variation in pressure, ink flows from ink channel 214 into the first air channel part 215*a* and then flows into connecting passage 222*a* having a small section, thereafter flowing through connecting passages 222*b* and 222*c*, so that there is a low possibility of retaining grooves 212 downstream of them being wetted. Therefore, it is possible to reduce the risk of blockage of air circulation which would disturb the ability of ink 2 to flow in and out. Thus, the rushing power of ink can be weakened as it goes through the air channel parts 215*a*, 215*b*, 215*c* and 215*d* turning in alternating directions while ink 2 is stored in retaining grooves 213 therealong, resultantly the pressure increase can be weakened as the ink reaches the front end with respect to the axial direction hence no ink 2 will erupt from vent hole 211.

Figure 13:
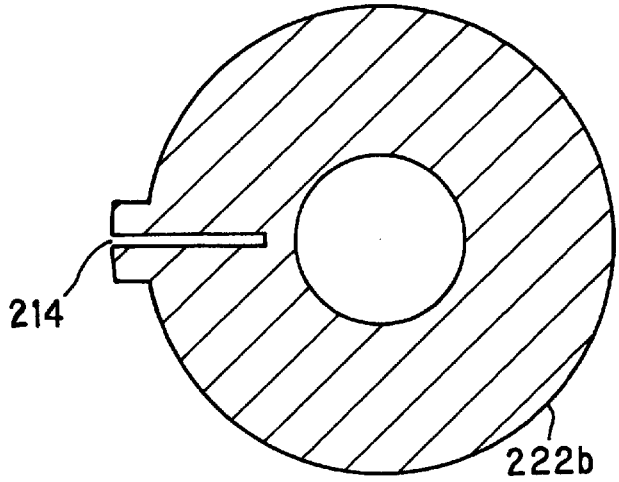

When pressure varies moderately, air circulates through zigzag air channel 215 while ink from the ink channel 214 side fills the retaining grooves of each of the blocks A, B, C and D, flowing in unique alternate directions, from one block to the next, so that air can positively circulate through air channel 215, thus no air circulation failures which would induce insufficient retention of ink 2 will occur. Therefore, ink 2 can be retained without 100% any loss even if the air channel has an intricate zigzag configuration, makingmultiple turns of direction. In particular, the configuration in which the outside diameter of the elements forming connecting passages 222 is made smaller than that of the vanes nearby around almost the full circumference excepting the part around ink channel 214, as shown in FIG. 13 is effective in inhibiting the above problems and also effective in producing the metal die.

In the third embodiment of the present invention, air channel 315 is formed by arranging its parts alternately at the position in proximity to ink channel 314 on the side where ink channel 314 is formed and at the position on the side opposite to ink channel 314 and by connecting and deflecting these parts with connecting passages 322*a*, 322*b* and 322*c* defined by the elements smaller than vanes 312. Thus, the rushing power of ink can be weakened as it goes through the winding air channel parts 315*a*, 315*b*, 315*c* and 315*d* and connecting passages 322*a*, 332*b* and 322*c* while ink 2 is stored in retaining grooves 313 therealong, resultantly the pressure increase can be weakened as the ink reaches the front end with respect to the axial direction hence no ink will erupt from vent hole 311.

Further, since in the third embodiment ink can flow only in one direction in the blocks where the air channel is located in the vicinity of the ink channel on the ink channel 314 side, there is a fear that air replacement failure in retaining grooves 312 might occur when the air channel side is wetted by inrush of ink due to a sharp variation in pressure or ink scatter when the pen is impacted by its being dropped. However, since the adjacent blocks with air channel 315 arranged on the side opposite ink channel 314 are interposed, ink can flow in and out at both sides of ink channel 314 in the latter blocks even when the air channel is wetted by sharp inrush of ink or ink scatter when the pen is impacted by its being dropped, whereby no ink eruption will occur.

Figure 8:
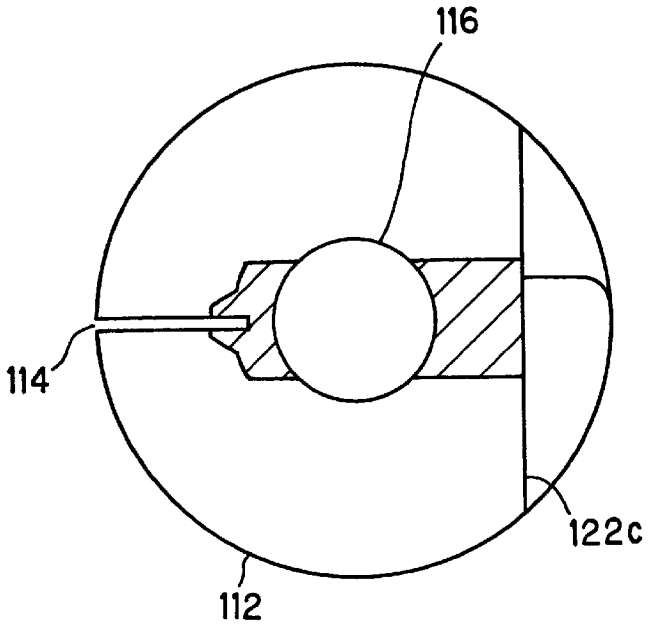
Figure 14:
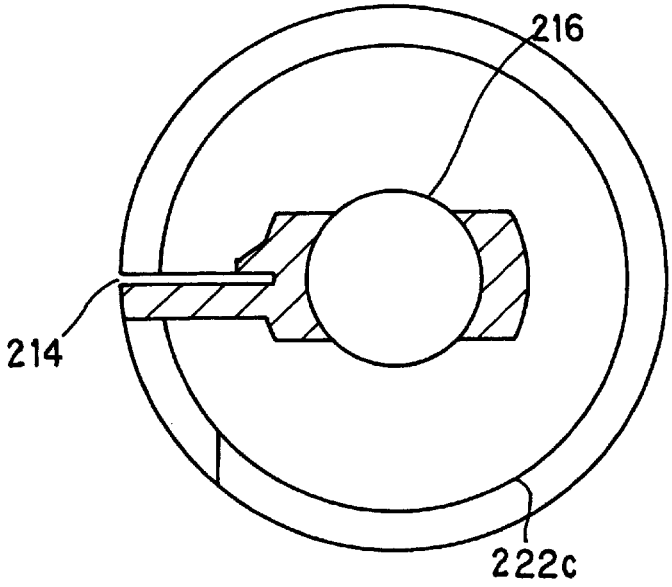
Figure 22:
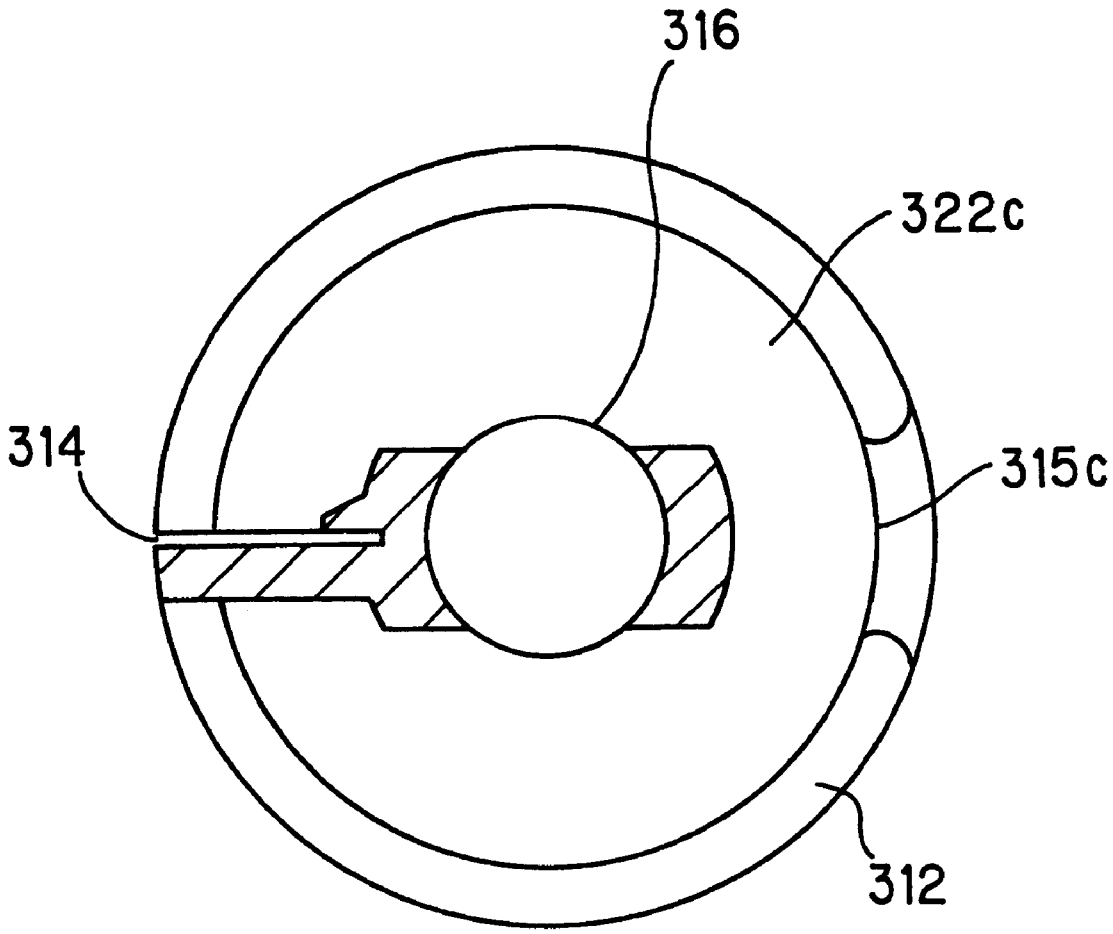

When the writing implement is used in an airplane, pressure not only acts on ink 2 in collector 6 but also acts on the interior of point assembly 1. Therefore, there is a problem of forward leakage by which ink 2, though in a small amount, leaks out from tip 9 of point assembly 1 at the moment cap 17 is removed in the airplane. In order to solve this problem, in addition to the above-described anti-eruption measures each of the first through third embodiments of the present invention is provided with an arrangement as shown in FIGS. 3 and 8 for the first embodiment, as shown in FIGS. 10 and 14 for the second embodiment and as shown in FIGS. 17 and 22 for the third embodiment. That is, for each collector 106, 206 and 306, a communication hole 116, 216 or 316 which provides communication with part of center core 8 connected to point assembly 1 or collector core 7 is formed in, at least, one of retaining grooves (113, 213 and 313), preferably located closer to air hole 10 side and at least the second or rear, so as to be somewhat forward with respect to the mid point thereof. The dimension Tr of communication hole 116, 216 and 316 is preferably greater than the width t of the smallest groove, forming a cross section equal to greater than ϕt.

With any of the collectors 106, 206 and 306 with the above communication holes 116, 216 and 316, if cap 17 is removed under reduced pressure in an airplane, the pressure which would cause ink 2 to leak out from tip 9 of point assembly 1 is released partway through communication hole 116, 216 or 316 toward retaining groove 113, 213 or 313. That is, a small amount of ink 2 may come out into retaining groove 113, 213 or 313, but the ink can be held in the retaining groove 113, 213 or 313. Resultantly, it is possible to prevent ink 2 from leaking forward from tip 9 of point assembly 1. Thus, it is possible to provide a writing implement which has the same configuration as the conventional one except in collector 106, 206 or 306.

Thus, with any of the above configurations of the first through third embodiments of the present invention, it is possible to provide a collector type writing implement which, not only has the conventional function of preventing ink from erupting due to a relatively moderate change of the interval pressure resulting from temperature variations but also can weaken, by providing an air channel having a multiple number of turns of the present invention, the power of rushing ink from the ink tank side into the air channel of the collector when a sharp change in pressure occurs as in the case where the pen is used in an airplane. Further, when at least one of the retaining grooves is connected to communicate with the interior of the point assembly, the pressure acting inside the point assembly can be relieved, thus making it possible to prevent ink from leaking forward from the tip of the point assembly. As a result, it is possible to provide a collector type writing implement which is totally prevented from accidental events such as ink eruption and forward leakage.

Further, there is low risk of air replacement through the retaining groove sections being affected even if rushing ink adheres to any site of the retaining grooves. Thus, the retaining grooves can be used under any circumstance, so that the configuration will not adversely affect the efficient function of adjusting the internal pressure and writing comfort, which are the advantage of a collector type writing implement.

INDUSTRIAL APPLICABILITY

As has been described, according to the present invention, it is possible to provide a writing implement which is slim and stylish in its appearance and excellent in cost performance. Further the occurrences of eruption deficiencies due to variations in pressure attributed to flight by plane or due to change in temperature as well as the occurrence of pumping deficiency resulting from fitting and removal of the cap can be inhibited, thus making it possible to provide a safety writing implement having stable writing performance. Particularly, it is possible to provide a writing implement which is free from eruption deficiencies even under circumstances where the ambient pressure is repeatedly decreased and increased due to flights by plane, such as a case where a businessman uses the pen while flying from place to place by plane.

It is possible to provide a collector type writing implement having the above effects and advantages without using either a special metal die configuration or a special assembly method compared to the conventional configurations. Therefore, it is possible to provide a collector type writing implement which is the same component cost as the conventional products, easy to manufacture, inexpensive and stylish in appearance with a long storage life.

What is claimed is:

1. A writing implement collector for adjusting the internal pressure of a writing implement having a point assembly with a writing point at the tip thereof, an ink tank for storing a relatively low viscosity ink, and a feeder means for feeding ink from the ink tank to the writing point, the collector comprising:

a multiple number of plate-like elements defining ink retaining grooves therebetween;

an ink channel extending through the multiple number of plate-like elements in the axial direction of the collector for connecting the ink retaining grooves;

an air channel defined by the arrangement of the multiple number of plate-like elements with cutouts or slots, wherein ink is introduced through the ink channel by the function of capillary action and temporarily held in the ink retaining grooves while air passage in the axial direction and radial direction is secured by the combination of the air channel and retaining grooves, characterized in that the air channel is continuously formed along the collector axis, zigzagging with a multiple number of turns of direction.

2. The writing implement collector according to claim 1, wherein the air channel is formed on the side opposite to the ink channel with respect to the axis of the collector.

3. The writing implement collector according to claim 1, wherein the air channel is formed on the same side as the ink channel with respect to the axis of the collector.

4. The writing implement collector according to claim 1, wherein the air channel is formed on the same side as, and on the side opposite, the ink channel with respect to the axis of the collector.

5. The writing implement collector according to claim 1, 2, 3 or 4, wherein the air channel is comprised of multiple linear channel parts each extending in the axial direction of the collector but adjacent parts being arranged different angular positions with respect to the axis of the collector while each plate-like element located at the boundary between adjacent linear channel parts has a cutout for defining a connecting groove for establishing communication between the adjacent linear channel parts.

6. The writing implement collector according to claim 1, 2, 3 or 4, wherein the collector is divided into multiple blocks in the axial direction thereof, each block forming an air channel while each plate-like element located between blocks, excepting the part around the ink channel, have an outside diameter smaller than that of the adjacent plate-like elements so as to form a connecting passage which establishes communication between the air channels of the adjacent blocks.

7. The writing implement collector according to claim 1, 2, 3 or 4, wherein the air channel is configured by providing only one cutout or slot on the periphery of each plate-like element.

8. The writing implement collector according to claim 1, 2, 3 or 4, wherein a communication hole for establishing communication with the feeder means is formed in, at least, one ink retaining groove.

9. The writing implement collector according to claim 1, 2, 3 or 4, wherein the ink tank directly stores therein a relatively low-viscosity ink having a viscosity of 2 to 100 mPa·sec at normal temperature.

* * * * *